United States Patent [19]

Kaczmarczyk et al.

[11] Patent Number: 4,986,722

[45] Date of Patent: Jan. 22, 1991

[54] MOUNTING STRUCTURE FOR A LOADER ATTACHMENT

[75] Inventors: Edward T. Kaczmarczyk, Welland; Rory Rae, Port Colborne, both of Canada

[73] Assignee: Deere & Company, Moline, Ill.

[21] Appl. No.: 352,000

[22] Filed: May 15, 1989

[51] Int. Cl.[5] ..... E02F 3/28

[52] U.S. Cl. ..... 414/723; 172/272

[58] Field of Search ..... 414/723, 912, 686; 172/272, 273, 274, 481; 37/231, 236, DIG. 12

[56] References Cited

U.S. PATENT DOCUMENTS

| | | | |
|---|---|---|---|
| 3,204,793 | 9/1965 | Lane . | |
| 3,672,521 | 6/1972 | Bauer et al. . | |
| 3,845,871 | 11/1974 | DiLillo et al. . | |
| 3,876,091 | 4/1975 | MacDonald . | |
| 3,883,015 | 5/1975 | Gorby . | |
| 3,887,096 | 6/1975 | Wieland . | |
| 3,964,622 | 6/1976 | Blair et al. . | |
| 3,985,249 | 10/1976 | Aker et al. . | |
| 4,106,645 | 8/1978 | Janish | 414/723 |
| 4,243,356 | 1/1981 | Takojima . | |
| 4,436,477 | 3/1984 | Lenertz et al. . | |
| 4,439,938 | 4/1984 | Grant | 414/723 X |
| 4,482,166 | 11/1984 | Van Antwerp | 172/272 X |
| 4,545,720 | 10/1985 | Cochran et al. . | |
| 4,643,631 | 2/1987 | Maurer et al. | 414/723 |
| 4,812,103 | 3/1989 | Cochran et al. | 172/272 X |
| 4,836,741 | 6/1989 | St. Louis et al. | 414/723 |

FOREIGN PATENT DOCUMENTS

| | | | |
|---|---|---|---|
| 852583 | 9/1970 | Canada | 414/723 |
| 1164323 | 2/1964 | Fed. Rep. of Germany | 414/723 |
| 1045825 | 10/1983 | U.S.S.R. | 172/272 |
| 8303629 | 10/1983 | World Int. Prop. O. | 414/723 |
| 8504440 | 10/1985 | World Int. Prop. O. | 414/723 |

OTHER PUBLICATIONS

John Deere Operator's Manual OM-W28596, Issue B3 (Feb. 1983), John Deere 240 and 245 Farm Loaders, cover page and pp. 38 and 39.

*Primary Examiner*—Frank E. Werner
*Assistant Examiner*—William M. Hienz

[57] ABSTRACT

Quick coupling structure which is selectively connectible to a loader attachment and includes a spring-loaded latching pin located on the attachment and easily viewed from the operator station. A pin-contacting member located on the loader boom arm automatically releases the pin allowing it to move to a locking position as the attachment is rocked about a pivotal axis by an attachment cylinder. An alternate interchangeable coupling structure is provided which may be utilized on the attachment when a quick coupler is not needed, and the pivot points for the attachment remain the same with either the quick coupler or the alternate coupling attached. An attachment holder utilized with the quick coupler may be eliminated when the alternate coupling structure is connected to the attachment.

21 Claims, 4 Drawing Sheets

FIG. 1
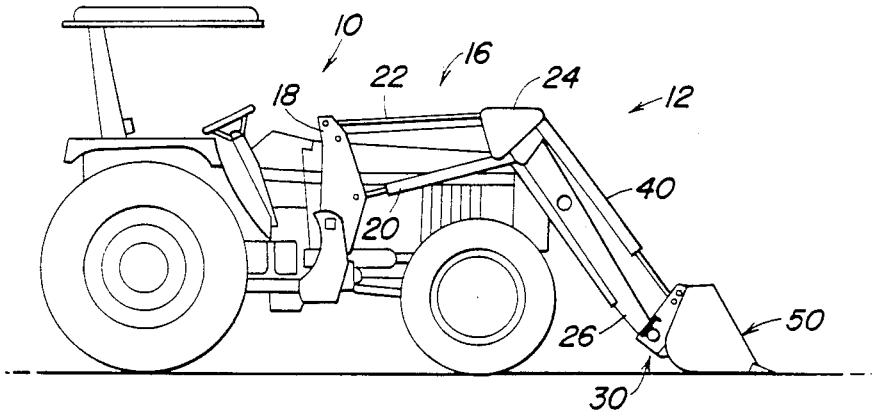
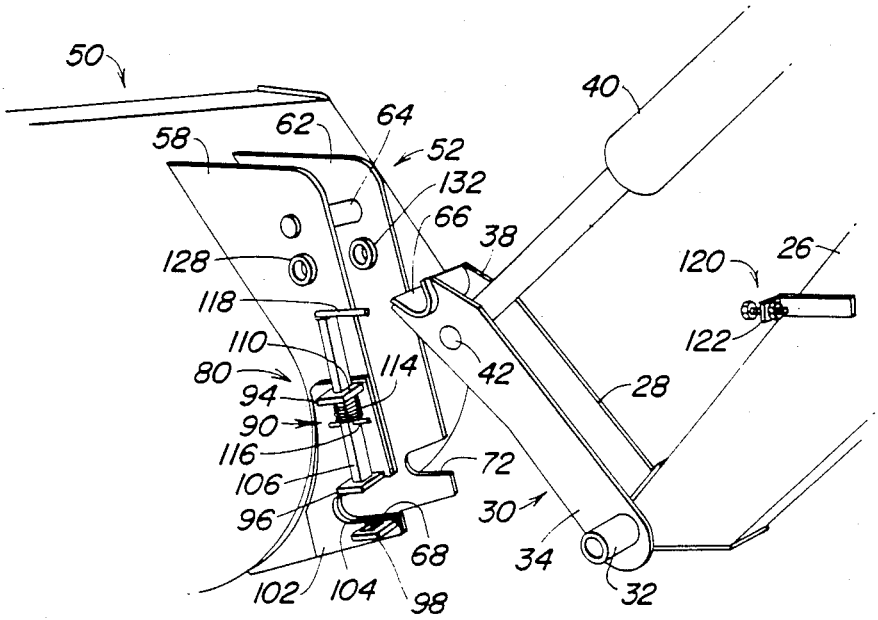
FIG. 2

MOUNTING STRUCTURE FOR A LOADER ATTACHMENT

BACKGROUND OF THE INVENTION

The present invention relates to a loader and, more specifically, to structure for mounting a bucket or similar attachment to a loader.

1. Field of the Invention

Many types of structures are available to connect a bucket or other device to the forward end of loader arms. Typically the device either includes a standard semi-permanent mounting arrangement wherein pins or bolts are manually connected between the arms and the attachment, or a relatively complex and more expensive quick coupler located on the arms and latchable automatically during mounting of the attachment. Making the necessary connections and disconnections during mounting and dismounting of the standard arrangement can be time-consuming and inconvenient. To speed mounting and dismounting of the attachment, various types of the quick coupling devices have been made available which reduce the number of times the operator has to leave the operator station during the procedures. Examples of such devices which typically include latching structure mounted on the boom arms are shown in U.S. Pat. Nos. 4,545,720; 3,876,091; 3,672,521 and 3,204,793.

One disadvantage with such boom-mounted devices is that the latching structure is usually locked by dumping or rolling action of the boom linkages; therefore the latch can be inadvertently moved to the locked position without the attachment connected. Once in the locked position, the latch will not permit the attachment to be mounted. Such inadvertent actuation of the latch is time-consuming and frustrating for the operator, and if he is not aware of the locked condition of the latch he can actually damage loader components or the attachment during the unsuccessful mounting attempt. In addition, the condition of the latch often is not readily apparent from the operator station of the vehicle, and the operator may not become aware of an improper connection until he tries to move the attachment.

Another disadvantage with most quick couplings is that they are relatively complex and expensive, and most are not readily adaptable to existing attachments. Some operators, such as those who use the vehicle primarily with the attachment mounted, do not want to pay the premium for a quick coupling that they will seldom use. Therefore, to satisfy the needs of all customers, an inventory of two similar attachments, one with a standard coupling and one with a quick coupling, is required and results in higher manufacturing and distribution costs.

A further disadvantage with most quick couplers is that the normal pivot points for the attachment are moved as much as five to nine inches resulting in adverse changes in the operating dimensions of the device with the attachment mounted. For example, on a front end loader the bucket reach, dump angle, and roll-back angle may be changed detrimentally from the ideal design configuration when a quick coupling is mounted on the boom arms. Bucket dump clearance, maximum lift height, digging depth, bucket to vehicle front hub distance and overall length of the vehicle with the bucket attached are affected as well.

BRIEF DESCRIPTION OF THE INVENTION

It is therefore an object of the present invention to provide an improved mounting structure for a loader boom attachment. It is a further object to provide such a structure which overcomes the aforementioned problems.

It is another object of the invention to provide an improved mounting structure for a loader boom attachment which assures that a reliable connection is made between the boom and the attachment during mounting. It is another object to provide such a structure which is relatively simple and inexpensive in construction and which is easily viewed from the operator station. It is still another object to provide such a structure which closely couples the attachment to the loader boom.

It is still a further object of the invention to provide an improved mounting structure for a loader boom attachment which facilitates incorporation of a quick coupling feature without changing the pivot points or other specific design dimensions of the loader. It is yet another object of the invention to provide such a structure wherein existing attachments may be easily converted to a quick coupling attachment and the need for separate inventories of attachments (with and without the quick coupling) is obviated. It is yet another object of the present invention to provide an improved loader mounting structure having an automatically actuated latch which is less apt to be inadvertently moved to the locked position without an attachment mounted on the boom. It is a further object to provide such a structure wherein the latch is located on the attachment rather than on the boom.

In accordance with the above objects, loader structure is provided which includes relatively simple quick coupling structure including a boom-mounted attachment carrier and a releasible spring-loaded pin located on the attachment and adapted for securing the attachment to the carrier when released. The pin is located for easy viewing by the operator, and once the attachment is properly located with respect to the boom, an extension on the boom contacts and releases the pin so that it assumes its locked position. Therefore, problems associated with improper connection of the attachment to the boom are avoided. The coupling is relatively simple and inexpensive in construction but is very reliable. In addition, provision is made to mount the attachment directly to the boom and the attachment cylinder without the quick coupling structure. The attachment locations remain the same and the same attachment may be utilized regardless of whether or not the quick coupling structure is provided. Therefore, the operator has the option of selecting either the less expensive, more permanent mounting arrangement or the quick coupling arrangement without need for the dealer or manufacturer having to provide an inventory of two attachments, one with and one without the quick coupling structure. Since the structure assures that the attaching points do not change, the operating dimensions and characteristics of the mounted attachment are substantially identical.

These and other objects, features and advantages of the present invention will become apparent to one skilled in the art upon reading the following detailed description in view of the drawings.

BRIEF DESCRIPTION OF THE DRAWINGS

FIG. 1 is a side view of a tractor-mounted loader with an attachment connected thereto.

FIG. 2 is an enlarged perspective view of forward end of one of the boom arms and a portion of the attachment with a quick coupler connected thereto, showing the attachment in the dismounted condition with the quick coupler in the unlocked position.

DESCRIPTION OF THE PREFERRED EMBODIMENT

Figure 3:
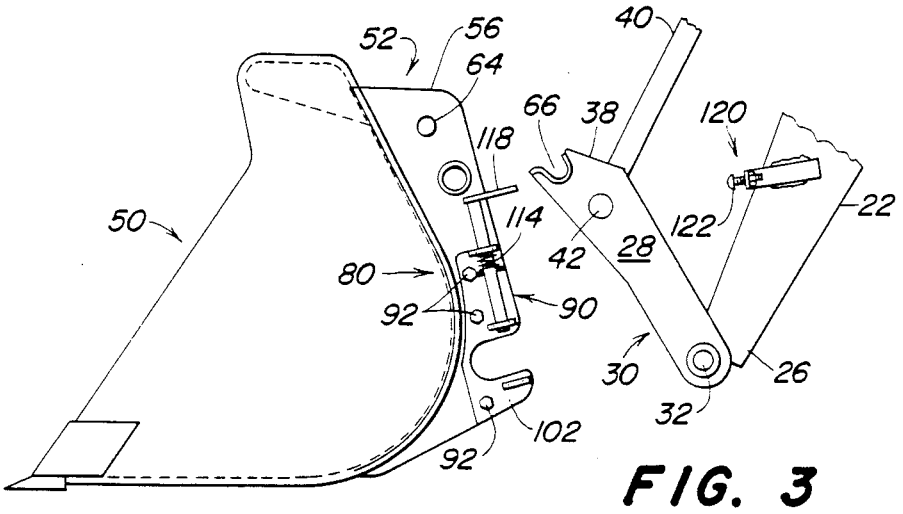
FIG. 3 is a side view of the structure shown in FIG. 2.

Referring now to FIG. 1, therein is shown a tractor 10 having a loader 12 connected thereto. The loader 12 includes a mast 16 pivotally connected to upright mast posts 18 for rocking in a conventional manner about a transverse axis by boom cylinders 20. The mast includes a pair of transversely spaced boom arms 22 extending forwardly from the mast posts 18 to knee joints 24. The arms 22 extend downwardly from the joints 24 to a lower, forward attachment mounting ends 26. An attachment holder 28 is pivotally connected to each end 26 to define an attachment carrier indicated generally at 30. A transversely extending pivot 32 projects outwardly from each side of the boom arm 22. The holder 28 is channel-shaped and has a lower end 34 opening about the boom arm end 26 and pivotally connected to the pivot 32. The holder 28 extends upwardly from the pivotal connection with the end 26 to an upper holder portion 38. The rod end of a corresponding attachment cylinder 40 at its rod end and base ends is pivotally connected at its rod end to the portion 38 at a pivot location 42 above the pivot 32. Actuation of the cylinders 40 rock the attachment holder 28 about the pivots 32 to control the attitude of the holder and any attachment connected thereto.

As shown in the Figures, the loader 12 is a front end loader, and the attachment is a loader bucket 50. However, it is to be understood that the present invention may be used with other types of attachments which are mounted on a boom.

The attachment or bucket 50 includes mounting structure indicated generally at 52 adapted for mating with the attachment holder 28 for firm support on the boom arms 22. As will be described in further detail below, the boom arms 22 and the cylinders 40 may be connected directly to the attachment mounting structure 52 (FIG. 7) for a more permanent mounting arrangement which does not require the holders 28.

The mounting structure 52 includes a pair of transversely spaced upright mounting brackets 56 fixed to the rear wall of the bucket 50. Each bracket 56 includes two transversely spaced plates 58 and 62 and opens rearwardly for receiving the corresponding attachment holder 28. Near the top of each bracket 56, a pin 64 extends transversely between the plates 58 and 62. The top of each holder 28 (FIGS. 2–6) includes an upwardly opening U-shaped support surface 66 adapted for engaging the lower portion of the pin 64 during mounting (FIG. 4) of the attachment. The surface 66 diverges in the upward direction to help guide the pin 64 to the proper location as the holder 28 is positioned within the bracket 56 during mounting.

Figure 4:
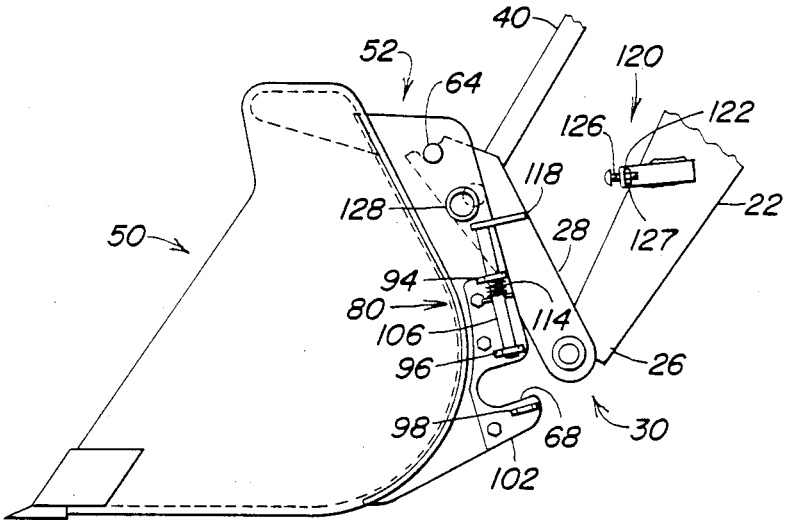
FIG. 4 is a view similar to FIG. 3 but showing the attachment carrier moving rotated from the mounted position.
Figure 5:
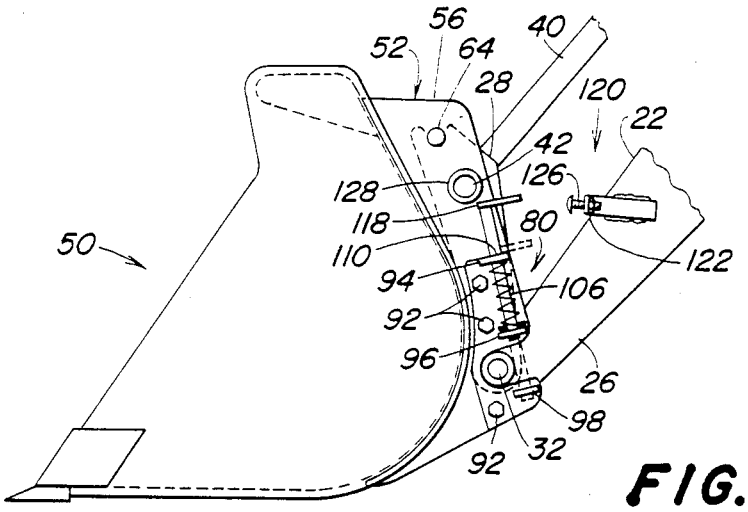
FIG. 5 is a view similar to FIG. 4 but showing the attachment carrier aligned with the quick coupler.

Rearwardly opening slots 68 and 72 located at the lower portions of the respective plates 58 and 62 are adapted to receive the corresponding transversely extending portions of the lower pivots 32 as the holders 28 are rolled back from the position shown in FIG. 4 to the position shown in FIG. 5. Retaining structure indicated generally at 80 in FIG. 3 is connected to the attachment brackets 56 for automatically locking the attachment to the boom as the pivots 32 move into the bracket slots 68 and 72.

Figure 7:
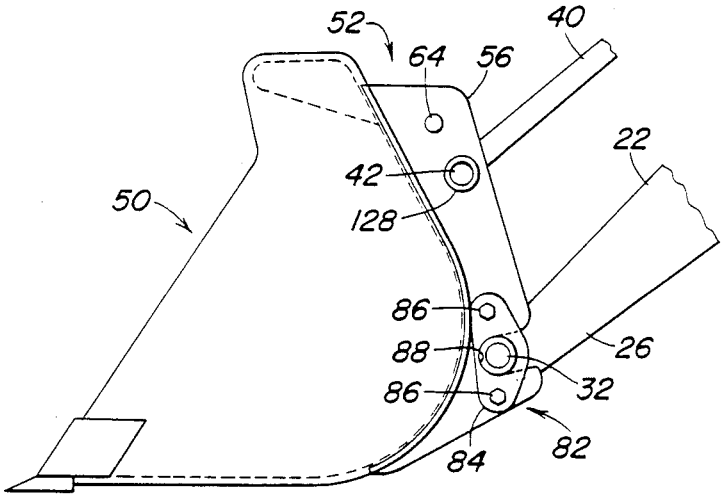
FIG. 7 is a view similar to FIG. 5 but showing the attachment with the alternate mounting structure in place of the quick coupling structure.

Alternatively as shown in FIG. 7, securing structure 82 for more permanent mounting of the attachment includes mounting plates 84 connected by bolts 86 to the plates 58 and 62. The plates 84 include apertures 88, and the extensions of the pivots 32 project through the apertures when the attachment is secured in the mounted position of FIG. 7. As is evident by comparing FIG. 5 and FIG. 7, the locations of the pivots 32 and 42 are identical for both the mountings 80 and 82 so that the operating dimensions and characteristics of the mounted attachment remain the same regardless of which mounting is selected. With the structure of FIG. 7, the attachment holders 28 are not utilized, and the rod end of each cylinder 40 is connected directly to the brackets 56 as will be described in detail below.

As seen in FIGS. 2–6 and 8, the retaining structure 80 includes a quick coupling device 90 bolted to the inner plate 58 of each bracket 56 by bolts 92. The device 90 includes an upper support member 94, an intermediate support member 96 and a lower support member 98 connected to a base plate 102 which, in turn, is fixed to the plate 58 by the bolts 92. The intermediate and lower support members 96 and 98 are offset on opposite sides of the slot 68 and a corresponding slot 104 (FIG. 2) in the base plate 102. The hole locations in the plate 58 for the two lowermost bolts 92 correspond to the hole locations for the bolts 86 which secure the plate 84 for the more permanent mounting arrangement of FIG. 7. Another hole location is provided near the upper support member 94 for a third bolt 92.

Figure 8:
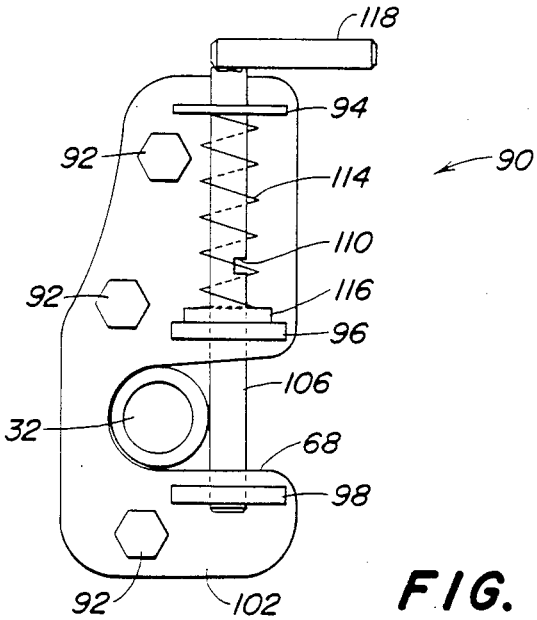
FIG. 8 is an enlarged side view of the latching structure in the tripped locking position.

The support members 94,96, and 98 are aligned in the upright direction and include aligned square apertures which slidingly receive a square locking pin 106 which is movable vertically between an upper release position (FIGS. 2–4) and a tripped or lower locking position (FIG. 8 and broken lines of FIG. 5). The locking pin 106 includes a central portion having a rearwardly opening notch 110 (FIG. 8) which rests against the upper member 94 when the pin 106 is in the release position. A coil spring 114 encircles the pin 106 and is compressed between a spring-retaining pin 116 and the bottom of the member 94 for biasing the pin 106 toward the locking position. By moving the pin 106 slightly forwardly until the notch 110 no longer registers with the upper member 94, the pin 106 moves downwardly under the bias of the spring 114 to the locking position wherein it extends between the intermediate and lower members 96 and 98 to trap the pivot 32 within the slots 68 and 72 (FIG. 8).

A handle 118 is fixed to the top of the pin 106 to provide a convenient grip for the operator for pulling the pin up to the release position for disconnecting the attachment 50. The handle also serves as part of a tripping mechanism for automatically moving the pin 106 to the locking position when connecting the attachment 50 to the boom arms 22. The pin 106 is located on the inside of the bracket 50 so that the operator has a clear view to determine easily if the pin is in the locked or unlocked position.

Figure 6:
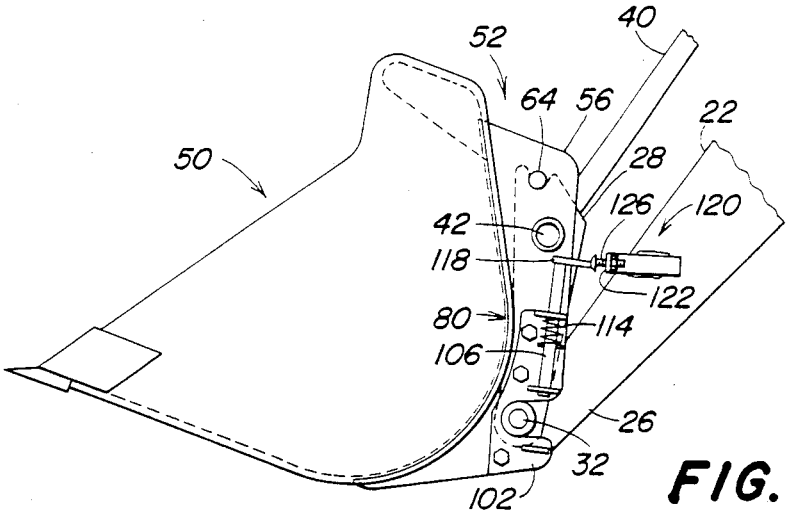
FIG. 6 is a view similar to FIG. 5 but showing the attachment rolled back with the latching structure about to be tripped to the locked position (solid lines).

For automatically tripping the pin 106 during mounting, an extension 120 is fixed to the lower end 34 of the boom arm 22 and supports an adjustable pin contacting member 122 which engages the handle 118 of the pin 106 as the attachment is rolled back as shown in FIG. 6. The member 122 includes a bolt 126 threaded into a nut 127 (FIG. 4) fixed to the forward end of the extension 120. The position of the head of the bolt 126 is adjusted (by turning the bolt 126 in the nut 127) so when the corresponding pivot 32 is in the slots 68 and 72 and the attachment 50 is rolled back (FIG. 6), the head contacts the handle 118 and moves the pin 106 forwardly to disengage the notch 110 from the member 94. The pin 106 then moves downwardly to the locking position to secure the pivot 32 within the slots 68 and 72 (FIG. 8).

Bushings 128 and 132 (FIG. 2) are located in the plates 58 and 62, respectively, of the brackets 56. When the semi-permanent mounting arrangement of FIG. 7 is utilized, each cylinder 40 is connected directly to the corresponding bracket 56 by manually inserting a longer pivot pin 42 through the bushings 128 and 132 and the rod end of each cylinder 40. The attachment 50 is then directly supported by the cylinders 40 and the pivots 32 without need for attachment holders 28. When the quick coupler arrangement of FIGS. 2-6 is utilized, the pins 64 positioned within the U-shaped support surfaces 66 of the holders 28 and the securing structures 82 provide good support for the attachment.

In operation to mount the attachment 50 with the quick coupler structure of FIGS. 2–6, each of the pins 106 is first moved upwardly to the unlocked positions. The operator moves the carrier 30 toward the attachment 50 (FIG. 3) and hooks the top of the holders 28 on the corresponding pins 64 (FIG. 4). The carrier 30 is then rolled back (FIG. 5) by retracting the cylinders 40, and the pivots 32 move into the slots 68 and 72. After the pivots 32 become fully seated in the slots, the operator continues to roll the attachment back (FIG. 6) until the head of the bolt 126 contacts the handle 118 and trips the pin 106 (FIG. 8), locking the pivots 32 to the mounting brackets 56 and securing the attachment 50 to the boom in closely coupled fashion. To disconnect the attachment 50, the operator pulls the pins 106 to the unlocked position and positions the notches 110 on the members 94. He then rocks the pivots 32 rearwardly away from the mounting brackets 56 (FIG. 4). Thereafter, he lowers the boom arms 22 and moves the holders 28 rearwardly (FIG. 3) free of the attachment 50.

Having described the preferred embodiment, it will become apparent to one skilled in the art that various modifications may be made while not departing from the scope of the invention as defined in the claims which follow.

We claim:

1. In a loader having movable boom arms and an attachment cylinder having a first end connected to the boom arms and a second end, connecting structure for mounting an attachment to the boom arms comprising:

selectable first and second means for connecting the attachment to the boom arms;

the first means comprising securing means for manually connecting the attachment to the boom arms and the cylinder for rocking of the attachment about a first axis;

wherein the second means comprises a quick coupling selectively interchangeable with the first means for alternately providing automatic connection of the attachment to the boom arms for rocking about a coupling axis when the second means is selected; and means pivotally connecting the second end of the cylinder to the attachment at a preselected location relative to the attachment when the first means is selected for rocking the attachment relative to the boom arms, said preselected location defining a cylinder connection pivotal axis;

means pivotally connecting the second end of the cylinder to the second means when the second means is selected, the pivotal connection defining a coupling pivotal axis substantially coinciding with the cylinder connection pivotal axis defined when the first means is selected;

wherein the locations of the first axis and the coupling axis are substantially identical relative both to the boom arms and to the attachment so that the operating dimensions and characteristics of the connected attachment remain essentially identical regardless of whether the first or the second means is selected.

2. The invention as set forth in claim 1 including means for supporting the quick coupling from the attachment.

3. The invention as set forth in claim 1 wherein the first means includes first support structure, and the quick coupling includes second support structure, and mans for alternately connecting the first and second support structure to a preselected location on the attachment.

4. The invention as set forth in claim 3 wherein the boom arms include a transversely extending pivot, the quick coupling includes means for receiving the pivot, and the first support structure includes means for supporting the attachment from the pivot.

5. The invention as set forth in claim 4 including interchangeable first and second supports carrying the quick coupling and the means for supporting the attachment, respectively, and means for selectively connecting the supports to the attachment.

6. The invention as set forth in claim 1 wherein the quick coupling comprises a latch movable between locking and unlocking positions and biased toward the locking position, means for releasibly maintaining the latch in the unlocking position, and means responsive to movement of the boom arms to a preselected position relative to the attachment for releasing the latch to the locking position to thereby secure the attachment to the boom arms.

7. The invention as set forth in claim 6 wherein the latch is connected to the attachment, and wherein the boom arms include an attachment carrier and the attachment includes a mating bracket for receiving the carrier, and the means responsive to the boom arm movement includes a latch-contacting member connected to the boom arms.

8. In a loader having movable boom arms and an attachment cylinder, connecting structure for mounting an attachment to the boom arms comprising:

an attachment carrier connected to the boom arms;

means operably connecting the cylinder to the attachment carrier for rocking the carrier relative to the boom arms about a first pivotal axis; and means for connecting the attachment to the attachment carrier for rocking with the carrier about the first pivotal axis, the means for connecting comprising a quick coupling connected to the attachment, said quick coupling defining a first cylinder connection pivotal axis offset from the first pivotal axis, and means for releasing the attachment carrier from the boom arms and cylinder, and means for connecting the cylinder and boom arms directly to the attachment when the attachment carrier is released for rocking the attachment about a pivotal axis substantially identical to the first pivotal axis, relative to both the boom arms and the attachment the direct connection defining a second cylinder connection pivotal axis generally coinciding with the first cylinder connection pivotal axis relative to both the boom arms and the attachment so that the operating dimensions and characteristics of the mounted attachment remain substantially identical with the without the quick coupling attached.

9. The invention as set forth in claim 8 wherein the quick coupling comprises an operator-viewable pin movable between latching and unlatching positions.

10. The invention as set forth in claim 9 wherein the pin is biased toward the latching position, means for maintaining the pin in the unlatching position against the bias, and means responsive to movement of the boom arms relative to the attachment for tripping the pin from the unlatching position to the latching position.

11. The invention as set forth in claim 10 wherein the means for maintaining the pin comprises a pin support member and a notched portion located on the pin and adapted for registry with the pin support.

12. In a loader having movable boom arms and an attachment cylinder, connecting structure for mounting an attachment to the boom arms comprising:

an upright attachment carrier having upper and lower portions;

means for connecting the attachment carrier to at least one of the boom arms for rocking about a first pivotal axis;

means operably connecting the cylinder to the attachment carrier for rocking the carrier relative to the boom arms about the first pivotal axis;

means for releasibly connecting the attachment to the attachment carrier for rocking with the carrier about the first pivotal axis, the means for releasibly connecting including a bracket connected to the attachment and having an upper portion adapted for engagement with the upper portion of the attachment carrier and a lower portion adapted for receiving the lower portion of the attachment carrier as the carrier is rocked with the upper portion of the carrier, engaging the upper bracket portion, and quick coupler structure selectively attachable to the bracket and including latch structure having latching and unlatching positions and responsive to the rocking of the carrier for automatically moving into the latching position when the upper portion of the carrier is engaged with the upper bracket portion, wherein when the attachment carrier is connected to the attachment, the connection of the cylinder to the carrier defines a first cylinder pivotal axis; and alternate mounting structure for selective replacement of the quick coupler structure for connecting the boom arm and cylinder directly to the attachment independent of the quick coupler structure for rocking about a second pivotal axis, said alternate mounting structure defining a second cylinder pivotal axis at the connection of the cylinder to the attachment and including means for establishing the second pivotal axis and second cylinder pivotal axis substantially identically located relative to both the boom arm and the attachment as the first pivotal axis and the first cylinder pivotal axis, respectively with the quick coupler structure so that the operating dimensions and characteristics of the connected attachment remain substantially identical when either the quick coupling structure or the alternate mounting structure is selected.

13. The invention as set forth in claim 12 wherein the attachment carrier is selectively removable from the boom arms and cylinder, and means for connecting the cylinder and boom arms directly to the attachment when the attachment carrier is released and the alternate mounting structure is selected.

14. The invention as set forth in claim 13 wherein the boom arms include a transversely extending pivot defining the first pivotal axis, the bracket includes a slot slidingly receiving the pivot, and the quick coupler structure includes means for automatically trapping the pivot in the slot as the carrier is rocked about the first pivotal axis.

15. The invention as set forth in claim 14 wherein the alternate mounting structure includes mounting means fixed to the attachment for securing the pivot within the slot when the alternate mounting structure is selected.

16. The invention as set forth in claim 14 further comprising:

an opening in the slot for receiving the pivot;

and wherein the means for automatically trapping the pivot includes a latch supported by the bracket adjacent the slot, the latch movable between a locking position wherein the opening is closed and an unlocking position wherein the opening accommodates movement of the pivot therethrough, means for biasing the latch toward the locking position, means for releasibly maintaining the latch in the unlocking position, and means responsive to relative movement between the boom arms and the attachment for automatically releasing the latch to the locking position.

17. The invention as set forth in claim 13 wherein the cylinder includes a rod end selectively positionable in the upper portion of the carrier when the quick coupling structure is selected, and positionable in the bracket when the alternate mounting structure is selected.

18. In a loader including boom arms and an extendible and retractable boom cylinder having a first end connected to the boom arms and a second end, connecting structure for mounting an attachment to the boom arms comprising:

selectable first and second means for connecting the attachment to the boom arms and to the second end of the boom cylinder for rocking the attachment about a pivotal axis when either the first or second means is selected; and wherein the first means includes a quick attachment coupler providing substantially automatic coupling of the attachment to the boom arms and second end of the cylinder, and the second means includes a manually installed securing structure, and means for mounting the manually installed securing structure relative to the attachment and the boom arms so that the pivotal axis remains virtually unchanged relative to both the attachment and boom arms when either the first or second means is selected, wherein the invention further includes means for connecting the second end of the cylinder at the same location relative to the attachment when the second means is selected as when the first means is selected so that the attachment position relative to the boom arms for a preselected extension of the cylinder is substantially identical when either the first or second means is selected.

19. The invention as set forth in claim 18 wherein the first means includes an attachment carrier and, when the first means is selected, the second end of the cylinder is pivotally connected to the attachment carrier, and said location relative to the attachment lies on a second pivotal axis.

20. The invention as set forth in claim 18 wherein the boom arms include a projecting pivot and the attachment includes a slot for receiving the projecting pivot when either the first or second means is selected.

21. The invention as set forth in claim 20 wherein the quick attachment coupler includes an automatically operated latch connected to the attachment for capturing the projecting pivot as the pivot is received in the sot, and the manually installed securing structure includes a mounting fixed to the attachment for securing the projecting pivot in the slot.

* * * * *